US010076009B2

(12) United States Patent
Creusen et al.

(10) Patent No.: US 10,076,009 B2
(45) Date of Patent: Sep. 11, 2018

(54) LIGHTING SYSTEM

(71) Applicant: PHILIPS LIGHTING HOLDING B.V., Eindhoven (NL)

(72) Inventors: Martinus Petrus Creusen, Wijlre (NL); Mark Johannes Antonius Verhoeven, Deurne (NL); Reinier Imre Anton Den Boer, Eindhoven (NL); Marcel Beij, Sint Oedenrode (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/567,999

(22) PCT Filed: Apr. 8, 2016

(86) PCT No.: PCT/EP2016/057738
§ 371 (c)(1),
(2) Date: Oct. 20, 2017

(87) PCT Pub. No.: WO2016/169789
PCT Pub. Date: Oct. 27, 2016

(65) Prior Publication Data

US 2018/0146526 A1 May 24, 2018

(30) Foreign Application Priority Data

Apr. 21, 2015 (EP) ..... 15164486

(51) Int. Cl.
*G05F 1/00* (2006.01)
*H05B 37/02* (2006.01)
(Continued)

(52) U.S. Cl.
CPC ..... *H05B 33/0848* (2013.01); *H05B 37/0227* (2013.01)

(58) Field of Classification Search
None
See application file for complete search history.

(56) References Cited

U.S. PATENT DOCUMENTS 8,680,969 B2 3/2014 Ackmann et al.
2009/0139972 A1 6/2009 Baker et al.
(Continued)

FOREIGN PATENT DOCUMENTS

WO 2011139548 A2 11/2011
WO 2013053862 A1 4/2013

*Primary Examiner* — Anh Tran
(74) *Attorney, Agent, or Firm* — Meenakshy Chakravorty

(57) ABSTRACT

The invention relates to a lighting system (1) comprising a lighting device (6) having a first USB-PD connector and a power providing unit, which is preferentially a component of a power providing device (4) and which is operable in different operational modes. A second USB-PD connector is electrically connected with the power providing unit and adapted to be connected with the first USB-PD connector for generating a USB-PD connection (5) via which power and optionally also data are receivable by the lighting device. A connection feature value being indicative of a feature of the connection is determined and the operational mode of the power providing unit is controlled depending on the determined connection feature value. This allows for a reaction on the current connection situation. For instance, if the connection feature value indicates a relatively low thermal coupling, the power providing unit may provide less power.

14 Claims, 8 Drawing Sheets

(51) Int. Cl.

| | |
|---|---|
| ***H05B 39/04*** | (2006.01) |
| ***H05B 41/36*** | (2006.01) |
| ***H05B 33/08*** | (2006.01) |

(56) References Cited

U.S. PATENT DOCUMENTS

| | | | | |
|---|---|---|---|---|
| 2011/0199013 | A1 | 8/2011 | Cottrell | |
| 2013/0038230 | A1 | 2/2013 | Brown et al. | |
| 2014/0245030 | A1 | 8/2014 | Helfrich et al. | |
| 2014/0368130 | A1* | 12/2014 | Catalano ..... | H05B 33/0884 315/309 |

* cited by examiner

LIGHTING SYSTEM

CROSS-REFERENCE TO PRIOR APPLICATIONS

This application is the U.S. National Phase application under 35 U.S.C. § 371 of International Application No. PCT/EP2016/057738, filed on Apr. 8, 2016, which claims the benefit of European Patent Application No. 15164486.1, filed on Apr. 21, 2015. These applications are hereby incorporated by reference herein.

FIELD OF THE INVENTION

The invention relates to a lighting system and to a power providing device for being used within the lighting system. The invention further relates to a control method and computer program for controlling the lighting system.

BACKGROUND OF THE INVENTION

WO 2013/053862 A1 discloses a controller for a driver circuit of a solid state light bulb assembly, wherein the solid state light bulb assembly comprises a light source and wherein the driver circuit comprises a power converter. The controller comprises a data storage unit for storing data items relating to an operating behavior of the light bulb assembly, a temperature sensor for determining a chip temperature of the controller and a data processing unit for receiving the chip temperature, for retrieving the stored data items from the data storage unit and for generating a control signal depending on the chip temperature and the retrieved data items. The data processing unit is further adapted to output the control signal to the power converter for operating the light source.

A lighting system generally comprises a power providing unit for providing power and several lighting devices, wherein such a lighting system can be relatively complex, especially if each lighting device needs to be connected to a power cable for receiving power from the power providing unit and to a data cable for exchanging control data with a control unit. Moreover, if a power connection or a data connection is faulty, the quality of the performance of the respective lighting device may be reduced. For instance, if heat generated by a lighting device should be dissipated via a connection and if the connection does not provide a sufficient thermal coupling, the lighting device may be heated to a temperature at which it cannot be operated properly or at which it will be destroyed.

SUMMARY OF THE INVENTION

It is an object of the present invention to provide a lighting system comprising a lighting device, which allows for an improved operation of the lighting device. It is a further object of the present invention to provide a power providing device for being used within the lighting system. Moreover, it is an object of the present invention to provide a control method and a computer program for controlling the lighting system.

In a first aspect of the present invention a lighting system is presented, wherein the lighting system comprises:

- a lighting device having a first universal serial bus power delivery (USB-PD) connector,
- a power providing unit for providing power to the lighting device, wherein the power providing unit is operable in a different operational modes,

- a second USB-PD connector electrically connected with the power providing unit and being adapted to be connected with the first USB-PD connector for generating a connection via which the provided power is receivable by the lighting device,
- a connection feature determination unit for determining a connection feature value being indicative of a feature of the connection formed by the first USB-PD connector and the second USB-PD connector, and
- a controlling system for controlling the lighting system, wherein the controlling system is adapted to control, in which operational mode the power providing unit is operated, depending on the determined connection feature value.

Since the first and second connectors are USB-PD connectors, the lighting device can receive the power and, if required, data like control information via a same single USB-PD connection. Moreover, since the connection feature determination unit determines a feature value being indicative of a feature of the USB-PD connection and since the controlling system controls the operational mode of the power providing unit and hence the power provision to the lighting device depending on the determined connection feature value, the lighting system can react on the feature and hence, for instance, on the quality of the USB-PD connection. This allows the lighting system to adapt the operation of the lighting device to the current USB-PD connection situation, which can lead to an improved operation of the lighting device. For instance, if the connection feature value indicates a relatively low thermal coupling between the first and second USB-PD connectors, the power providing unit may be operated in an operational mode in which it provides a relatively low power to the lighting device, in order to not heat the lighting device to a temperature at which the lighting device cannot be operated properly or at which the lighting device might even be damaged.

The power providing unit is preferentially adapted to provide in a first operational mode a first power and in a second operational mode a second power, wherein the first power is lower than the second power, wherein the amount of power provided to the lighting device is chosen depending on the connection feature value indicating the feature of the connection like the quality of the thermal coupling of the connection. For instance, the controlling system may be adapted to control the lighting system such that a) the connection feature determination unit determines the connection feature value while the power providing unit is in the first operational mode and b) the power providing unit changes from the first operational mode to the second operational mode depending on the determined connection feature value, especially only if the connection feature value indicates a sufficiently good coupling between the first and second USB-PD connectors.

In an embodiment the power providing unit is adapted to provide the power by using pulse-width modulation (PWM) having a duty cycle, wherein the power providing unit is adapted to be operable in a third operational mode, in which the power providing unit provides the second power with a duty cycle being smaller than the duty cycle used in the second operational mode, wherein the controlling system is adapted to control the lighting system such that a) the connection feature determination unit determines the connection feature value while the power providing unit is in the first operational mode and b) the power providing unit changes from the first operational mode to the third operational mode depending on the determined connection feature value. In particular, if the determined connection feature value indicates a relatively low thermal coupling quality, the power providing unit may be operated in the third operational mode and, if the connection feature value indicates a relatively high thermal coupling quality, the power providing unit may be operated in the second operational mode. Thus, the higher power may also be provided, if the determined connection feature value indicates, for instance, a relatively low thermal coupling quality, but in this case the provision of the higher power may be such that the lighting device is not heated too much by choosing the duty cycle accordingly. The controlling system can be adapted to compare the connection feature value with a threshold and to control the power providing unit such that it is operated in the second operational mode with the larger duty cycle, if the comparison indicates a larger coupling quality, and in the third operational mode with the smaller duty cycle, if the comparison indicates a smaller coupling quality. Thus, if the connection feature value indicates a relatively bad coupling, less energy may be provided to the lighting device, in order to not heat the lighting device too much.

The power providing unit can be a part of a power providing device, which may also comprise at least a component of the controlling system, wherein the connection feature value can be a value which is indicative of, for instance, the compatibility of the power providing device and the lighting device regarding, for example, heat dissipation or functionality. In particular, the connection feature value can be the temperature of the lighting device, wherein it can be assumed that, if the lighting device and the power providing device are not compatible regarding a heat dissipation function, the temperature of the lighting device might become too high. The connection feature determination unit may also be adapted to determine a connection feature value being indicative of the electrical status of the connection, for instance, being indicative of whether the power provided by the power providing unit, especially allocated by the power providing unit, corresponds to the power needed by the lighting device. The connection feature determination unit can also be adapted to determine a connection feature value indicating whether the connection is mechanically secure, for instance, if the first and second USB-PD connectors are to be mechanically secured by using a latching mechanism, whether the connection has been fully latched, or, if the first and second USB-PD connectors are inserted into each other for generating the connection, whether they have been completely inserted into each other. Also in these cases the connection feature value may be a temperature value, especially the temperature of the lighting device, because an inappropriate mechanical connection can lead to disturbed heat dissipation from the lighting device such that the temperature of the lighting device might become too high. The connection feature determination unit may also be adapted to determine a connection feature value being indicative of the relative position of the lighting device to the power providing device. For instance, if the power providing device comprises optical elements, which should influence the light generated by the lighting device, if the lighting device has been connected to the power providing device, an inappropriate position of the power providing device relative to the lighting device can lead to an inappropriate positioning of the optical elements relative to the lighting device. In this case the inappropriate relative positioning may be detected by using an optical detector detecting light after having been influenced by the optical elements, or by an optical detector arranged at a position within the power providing device, at which light generated by the lighting device should not be present, if the lighting device and the power providing device are correctly aligned relative to each other. An incorrect relative positioning may also be related to a reduced thermal coupling between the first and second USB-PD connectors such that also in this case the connection feature value may be a temperature value being indicative of the temperature of the lighting device.

Thus, in an embodiment the connection feature determination unit is adapted to determine a temperature value being indicative of the temperature of the lighting device and/or of the first USB-PD connector and/or of the second USB-PD connector and/or of the power providing unit as the connection feature value. The temperature value can be a temperature or it can be another parameter being indicative of the temperature. In an embodiment the connection feature determination unit comprises a temperature sensor for directly measuring the temperature. The temperature sensor might be embedded in the lighting device and/or the first USB-PD connector and/or the second USB-PD connector and/or the power providing unit.

The lighting device preferentially comprises an LED, wherein in this case the connection feature determination unit may be adapted to determine the temperature value such that it is indicative of the junction temperature of the LED. The temperature value can directly be the junction temperature. Moreover, the connection feature determination unit can be adapted to determine the forward voltage of the LED, in order to determine the temperature value being indicative of the junction temperature. In particular, the forward voltage itself, a change of the forward voltage relative to the forward voltage at a certain point in time or another value derived from the forward voltage and/or the change of the forward voltage can be used as temperature value.

The temperature is a good indicator for the connection quality, because, if the thermal coupling is not good, which may be accompanied by a bad electrical and mechanical coupling, heat will not be properly dissipated via the first and second USB-PD connectors to other parts of the lighting system and gather in the lighting device. A relatively high temperature of the lighting device and/or a relatively low temperature of other components of the lighting system can therefore indicate that the connection quality is not very good leading to a reduced heat dissipation from the lighting device to one or several other components of the lighting system.

The lighting system preferentially comprises an output unit for outputting a signal depending on the connection feature value. For instance, if the connection feature value indicates that the power providing device and the lighting device are not compatible or that the connection is not mechanically secure, which might lead to a too high temperature of the lighting device due to reduced heat dissipation, the temperature of the lighting device may be measured, in order to provide the connection feature value and a signal may be output, if the temperature is a higher as a predefined temperature threshold. Preferentially, the output unit and the lighting device form an integrated unit, i.e. the light generated by the lighting device is used for outputting the signal. Thus, it can be indicated, for instance, if the determined connection feature value corresponds to insufficient heat dissipation, whereupon a user like an installer can, for example, improve the connection. After the user has improved the connection, the lighting device may be operated in the second operational mode.

In particular, the power providing unit may be adapted to provide in a first operational mode a first power and in a second operational mode a second power, wherein the first power is lower than the second power, wherein the controlling system is adapted to control the output unit such that the signal is output depending on the connection feature value while the power providing unit is operated in the first operational mode. Thus, already in the first operational mode it can be indicated that, for instance, the connection is faulty which may lead to an insufficient heat dissipation, wherein in this case the operation of the power providing unit is preferentially not changed from the first operational mode to the second operational mode. A user is informed by the output signal that the connection is faulty, whereupon the user can improve the connection. The connection feature value can then be determined again and, if the connection quality is sufficient now, the power providing unit can be controlled to be operated in its second operational mode. In an embodiment the lighting system can therefore be controlled such that the lighting device receives the higher power only, if the coupling between the first USB-PD connector and the second USB-PD connector is sufficient, thereby ensuring a proper operation of the lighting device.

The output unit is preferentially adapted to output an optical signal, for instance, a blinking signal and/or a signal having a certain color depending on the connection feature value.

If the output unit and the lighting device are integrated such that the signal is output as an optical signal via the lighting device, it is not required to provide an additional output unit, but the lighting device itself can output the signal depending on the determined connection feature value. For instance, if the connection feature value indicates a relatively low quality, which has been revealed by a comparison with a threshold, the lighting device may output a certain signal like a blinking signal or a signal having a certain color like a red color. If the connection feature value indicates a relatively high connection quality, a signal indicating the connection quality may not be output or a signal indicating the relatively high connection quality may be output.

In an embodiment the lighting system comprises several lighting devices having several first USB-PD connectors, several second USB-PD connectors electrically connected with one or several power providing units and being adapted to be connected with the first USB-PD connectors for generating electrical connections via which the provided power is receivable by the lighting devices, wherein the output unit is integrated with the lighting devices such that, if the connection feature determination unit determines the connection feature value of a connection formed by a first USB-PD connector of a certain lighting device and a second USB-PD connector, the signal is output depending on the connection feature value as optical signal via a neighboring lighting device. Thus, if a relatively low connection quality of a connection between a first USB-PD connector and a second USB-PD connector has been determined, this low quality connection can be indicated by outputting a signal via the lighting device connected to this connection and/or via neighboring lighting devices.

Preferentially, the controlling system is adapted to compare the connection feature value with a threshold and to determine whether the connection feature value indicates a sufficient coupling based on this thresholding. For instance, the controlling system can be adapted to change the operation of the power providing unit from the first operational mode to the second operational mode depending on the comparison with the threshold. In particular, the controlling system can be adapted to change the operation of the power providing unit from the first operational mode to the second operational mode, only if the connection feature value is, for instance, larger or smaller than the threshold.

Preferentially the lighting device comprises one or several LEDs. In particular, the lighting device can be an LED module comprising several LEDs. The power providing unit can be adapted to transform power received from a central power supply like a mains power supply to the respective lower power or higher power. The power providing unit can be a component of a power providing device which might be an LED driver. In particular, the lighting system can comprise a combination of an LED module and an LED driver forming an LED light engine (LLE).

The first USB-PD connector and the second USB-PD connector are preferentially adapted to provide a USB-PD connection in accordance with the USB-PD standard. Correspondingly, at least the lighting device and the power providing unit are preferentially in accordance with the USB-PD standard.

In an embodiment the connection feature determination unit is adapted to determine whether the connection comprises miswiring and to provide the connection feature value such that it is indicative of whether miswiring has been determined. The output unit may be adapted to output a signal depending on the miswiring determination. Thus, if there is miswiring, this can be indicated to a user who can correct the miswiring, in order to ensure a proper operation of the lighting device. Preferentially, the controlling system is adapted to control the lighting system such that the determination of the miswiring is performed, while the power providing unit provides the lower power in the first operational mode, wherein the power provision is changed from the lower power in the first operational mode to the higher power in the second operational mode, only if no miswiring has been determined.

One of the first and second USB-PD connectors is preferentially a male connector and the other of the first and second USB-PD connectors is preferentially a female connector. In an embodiment the first and second USB-PD connectors are adapted such that they are connectable to each other by plugging the first and second USB-PD connectors into each other, by, especially arbitrary, rotating the first and second USB-PD connectors relatively to each other to a relative rotational position and by mechanically fixing the first and second USB-PD connectors relative to each other at the relative rotational position. The first USB-PD connector and/or the second USB-PD connector can comprise extendable electrical coupling elements, in order to provide the mechanical fixing by extending the electrical coupling elements. Thus, after the first and second USB-PD connectors have been plugged into each other, especially by sliding one of the connectors into the other of the connectors, the lighting device may be rotated to a desired rotational position, thereby rotating the connectors relative to each other, whereafter the lighting device can be mechanically fixed at the desired rotational position by mechanically fixing the connectors relative to each other. The rotational position of the lighting device can therefore be chosen in a technically relatively simple way, especially without requiring technically more complex interfaces between the lighting device and the power providing unit for providing the rotational adjustment property.

In a further aspect of the present invention a power providing device for being used within the lighting system as defined in claim 1 is presented, wherein the power providing device comprises:

a power providing unit for providing power to a lighting device of the lighting system, wherein the power providing unit is operable in different operational modes, a second USB-PD connector electrically connected with the power providing unit and being adapted to be connected with a first USB-PD connector of the lighting device for generating a connection via which the provided power is receivable by the lighting device, a controller for controlling, in which operational mode the power providing unit is operated, depending on a connection feature value determined by a connection feature determination unit of the lighting system.

In a further aspect of the present invention a control method for controlling a lighting system as defined in claim 1 is presented, the controlling method comprising:

determining a connection feature value being indicative of a feature of a connection, which is formed by a first USB-PD connector of a lighting device and a second USB-PD connector electrically connected with a power providing unit and via which the provided power is receivable by the lighting device, and controlling, in which operational mode the power providing unit is operated, depending on the determined connection feature value.

In another aspect of the present invention a computer program for controlling a lighting system as defined in claim 1 is presented, wherein the computer program comprises program code means for causing the controlling system of the lighting system to carry out the steps of the control method as defined in claim 13, when the computer program is run on the controlling system.

It shall be understood that the lighting system of claim 1, the power providing device of claim 12, the control method of claim 13 and the computer program of claim 14 have similar and/or identical preferred embodiments, in particular, as defined in the dependent claims.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
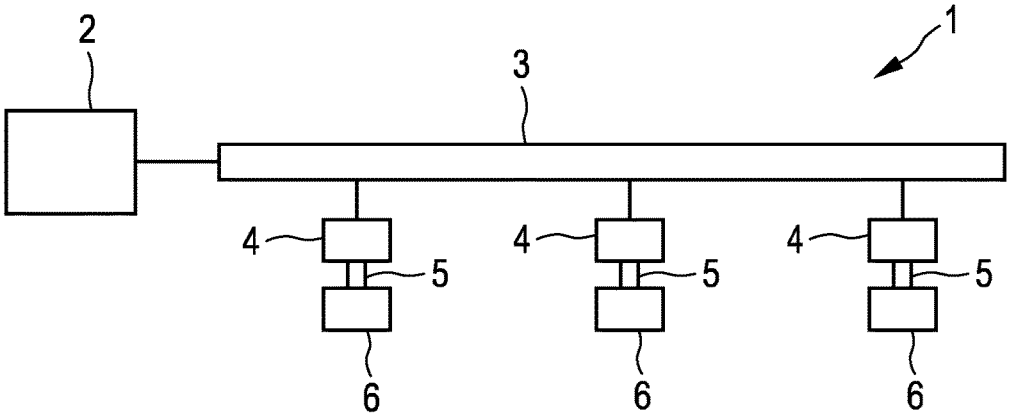
FIG. 1 shows schematically and exemplarily a lighting system comprising several power providing devices and several lighting devices.
Figure 2:
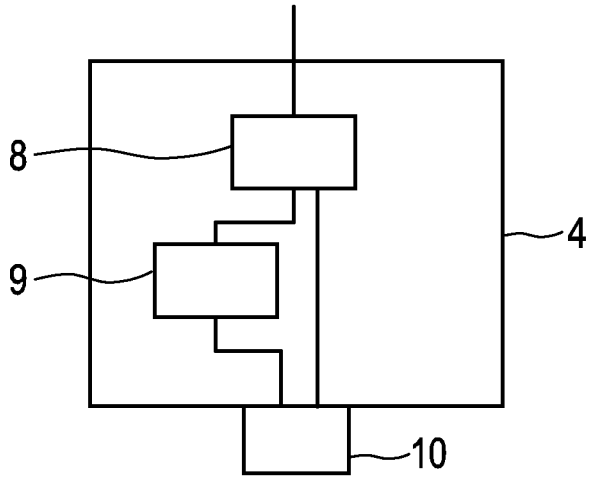
FIG. 2 shows schematically and exemplarily an embodiment of the power providing device of the lighting system.

FIG. 1 shows schematically and exemplarily an embodiment of a lighting system. The lighting system 1 comprises a power track 3 connected to a central power source 2 like a mains power source. The central power source 2 supplies power which is distributed to power providing devices 4 via the power track 3. The power providing devices 4 are connected to lighting devices 6 via connections 5. One of the power providing devices 4 is schematically and exemplarily shown in more detail in FIG. 2.

The power providing device 4 comprises a power providing unit 8 for providing power to the respective lighting device 6, wherein the power providing unit 8 is operable in a first operational mode, in which a lower power is provided, and a second operational mode, in which a higher power is provided. The power providing unit 8 is preferentially adapted to transform the power supplied by the central power supply 2 via the power track 3 to the lower power or the higher power, respectively, to be provided to the respective lighting device 6. The power providing device 4 further comprises a USB-PD connector 10 which is adapted to be connected to a USB-PD connector of the respective lighting device 6. In the following the USB-PD connector of the lighting device 6 will be named first USB-PD connector and the USB-PD connector 10 of the power providing device 4 will be named second USB-PD connector.

Figure 3:
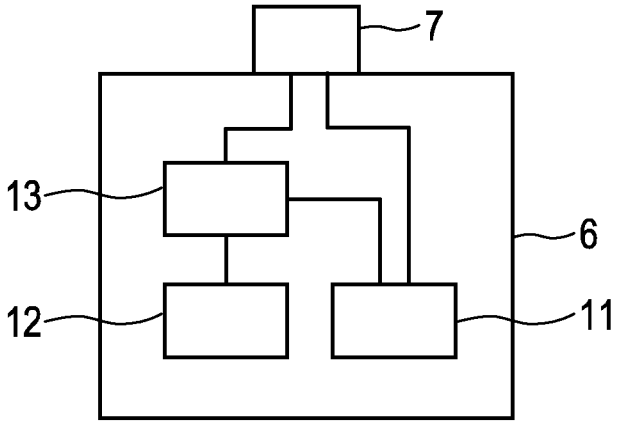
FIG. 3 shows schematically and exemplarily an embodiment of a lighting device of the lighting system.

One of the lighting devices 6 is schematically and exemplarily shown in more detail in FIG. 3. The lighting device 6 comprises the first USB-PD connector 7, an LED 11 connected to the first USB-PD connector 7 and a connection feature determination unit 12 for determining a connection feature value being indicative of the quality of the connection formed by the first USB-PD connector 7 of the lighting device 6 and the second USB-PD connector 10 of the power providing device 4. The lighting device 6 further comprises a controller 13 for controlling the components of the lighting device 6.

The first and second USB-PD connectors 7, 10 form a USB-PD connection 5. Also the other components of the power providing device 4 and the lighting device 6 are USB-PD devices, i.e. devices in accordance with the USB-PD standard. The USB-PD connectors and the USB-PD devices may be in accordance with version 1.0 of the USB-PD standard and/or in accordance with another version of this standard. The controller 9 of the power providing device 4 and the controller 12 of the lighting device 6 communicate with each other via the USB-PD connection and form a controlling system for controlling the lighting system 1. In particular, the controlling system, especially the controller 13, is adapted to control the lighting device 6 such that the connection feature determination unit 12 determines the connection feature value while the power providing unit 8 of the respective power providing device 4 is in the first operational mode. Moreover, the controlling system, especially the controller 9, is preferentially adapted to control the power providing unit 8 such that it changes from the first operational mode to the second operational mode depending on the determined connection feature value which may be communicated via the controller 13 of the lighting device 6 or directly from the connection feature determination unit 12 to the controller 9 of the power providing device 4. In particular, the controller 9 is preferentially adapted to compare the determined connection feature value with a threshold and to change the operation of the power providing unit 8 from the first operational mode to the second operational mode depending on the comparison with the threshold, especially only if the comparison indicates a sufficient connection quality. If the connection quality is not sufficient, the LED 11 is controlled such that it outputs a signal indicating the insufficient connection quality. For instance, the LED 11 may blink or may provide light having a certain color like a red color. The lighting device 6, especially the LED 11, can therefore also be regarded as being an output unit which is adapted to output a signal depending on the determined connection feature value. The lighting device 6 may therefore not only be used for general illumination purposes, but also for indicating if the quality of the connection formed by the first USB-PD connector 7 and the second USB-PD connector 10 is not sufficient. In particular, the controller 13 can be adapted to control the LED 11 such that it outputs the signal indicating the insufficient connection quality, if a comparison of the connection feature value determined by the connection feature value determination unit 12 with a threshold indicates an insufficient connection quality. If the comparison with the threshold indicates a sufficient connection quality, the power providing unit 8 will provide the higher power in the second operational mode and the LED 11 will be operated with the provided higher power.

The connection feature determination unit 12 is adapted to determine a temperature value being indicative of the temperature of the lighting device 6 as the connection feature value. For instance, the connection feature determination unit 12 can comprise a temperature sensor which is arranged close to the LED 11 or even integrated in the LED 11, in order to measure the temperature of the LED 11 and to provide the measured temperature as the temperature value being indicative of the temperature of the lighting device 6. However, the connection feature determination unit 12 can also be adapted to determine a temperature value being indicative of the temperature of the lighting device 6 in another way. For instance, the connection feature determination unit 12 can be adapted to determine the forward voltage of the LED 11 and to use the forward voltage or a change of the forward voltage as a temperature value being indicative of the temperature of the lighting device 6, i.e. in this case of the junction of the LED 11. Thus, the forward voltage itself or a change of the forward voltage relative to a forward voltage at a certain point in time can be indicative of the junction temperature of the LED 11 and can therefore be used as a temperature value. Also a value derived from the forward voltage and/or the change of the forward voltage can be used as the temperature value. For instance, known assignments between a) a forward voltage or a forward voltage change and b) temperatures can be used for determining the junction temperature as the temperature value being indicative of the temperature of the lighting device 6.

Figure 4:
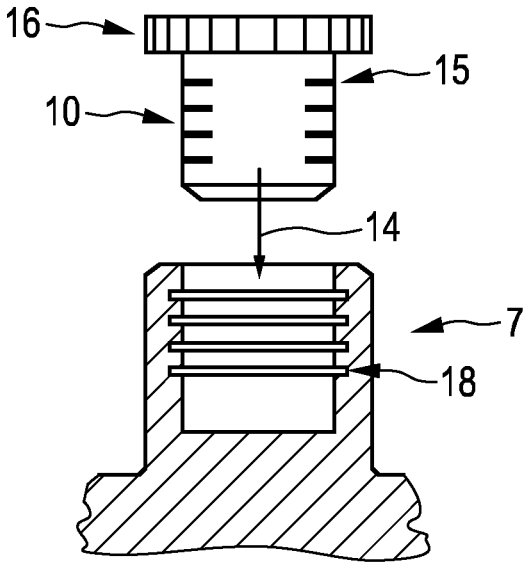
FIG. 4 shows schematically and exemplarily an embodiment of a first USB-PD connector of a lighting device and of a second USB-PD connector of a power providing device.
Figure 5:
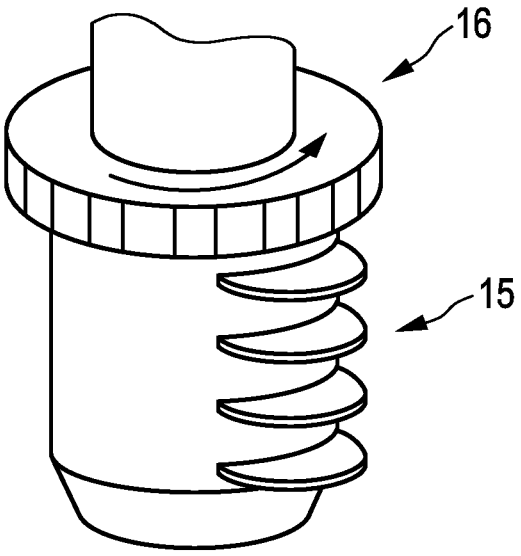
FIG. 5 shows schematically and exemplarily the embodiment of the second USB-PD connector in more detail.
Figure 6:
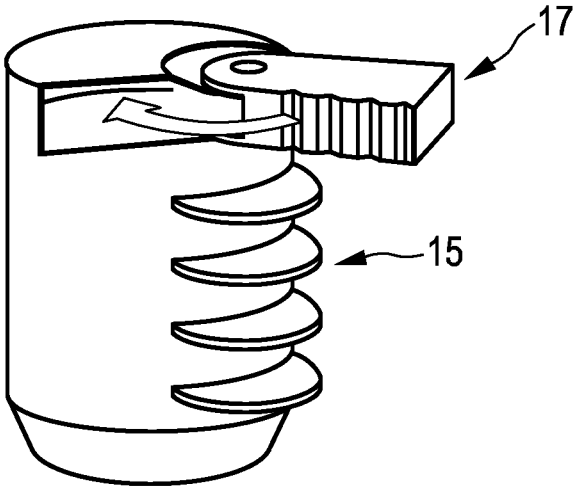
FIG. 6 shows schematically and exemplarily a further embodiment of the second USB-PD connector.

FIG. 4 shows schematically and exemplarily embodiments of the first USB-PD connector 7 and the second USB-PD connector 10 in more detail. As can be seen in FIG. 4, in this embodiment the first USB-PD connector 7 is a female connector and the second USB-PD connector 10 is a male connector. The male connector 10 is slidable into the female connector 7 as indicated by the arrow 14 and comprises extendable electrical coupling elements 15 which can be inside the male connector 10 as schematically and exemplarily shown in FIG. 4, but which can also be extended such that they protrude from an outer surface of the male connector 15 as schematically and exemplarily indicated in FIG. 5. The male connector 10 comprises a state change element 16 for allowing an installer to change the state of the male connector 10 from a configuration, in which the electrical coupling elements 15 are within the male connector 10, and a state, in which the electrical coupling elements 15 are extended such that they protrude from the outer surface of the male connector 10. The state change element 16 can be a ring element as schematically and exemplarily shown in FIGS. 4 and 5. However, in another embodiment the state change element can also be another element like a lever 17 as schematically and exemplarily shown in FIG. 6. In an embodiment the male connector 10 comprises a spring construction for biasing the electrical coupling elements 15 to protrude over the outer surface of the male connector 10 and a pull mechanism for pulling the electrical coupling elements 15 against the spring forces into the male connector 10 by rotating the ring element 16 or pushing the lever 17, respectively.

After the male connector 10 has been slid into the female connector 7, the two connectors 7, 10 can be rotated relative to each other, in order to adjust the rotational position of the lighting device 6 as desired, whereafter the installer can mechanically fix the male connector 10 within the female connector 7 at the desired rotational position by actuating the ring element 16 or the lever 17 such that the electrical coupling elements 15 are extended and get in contact with corresponding coupling elements 18 within the female connector 7. The coupling elements 18 within the female connector 7 are formed by ring-like grooves in which the electrical coupling elements 15 can be pressed, in order to mechanically fix the male connector 10 within the female connector 7 and in order to establish an electrical, mechanical and thermal coupling between the two connectors 7, 10. In this embodiment each of the coupling elements 15 on one side of the male connector 10 is in electrical contact with a corresponding one of the coupling elements 15 on the opposite side of the male connector 10, i.e. in this embodiment the male connector 10 provides four separate electrical contacts which can be connected with the corresponding four electrical contacts, i.e. the four electrical coupling elements 18, of the female connector 7. In other embodiments the female connector 10 and the male connector 7 can of course be adapted to provide more than four or less than four electrical contacts.

Figure 7:
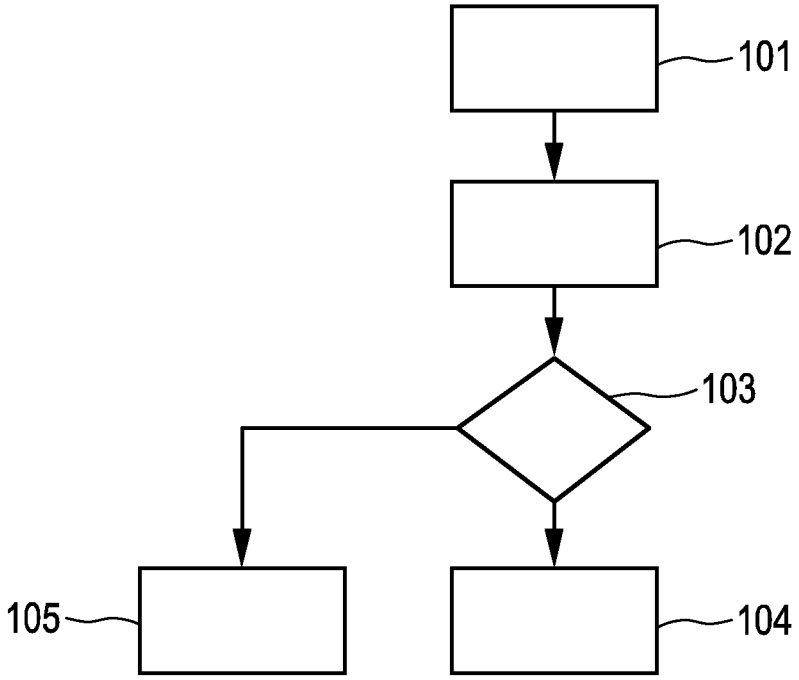
FIG. 7 shows a flowchart exemplarily illustrating an embodiment of a control method for controlling the lighting system.

In the following an embodiment of a control method for controlling the lighting system 1 will exemplarily be described with reference to a flowchart shown in FIG. 7.

After the lighting devices 6 have been connected to the power providing devices 4, the controlling system controls the power providing units 8 of the power providing devices 4 such that they provide the lower power in step 101. While the lower power is provided, in step 102 the respective connection feature determination unit 12 determines the respective connection feature value. In particular, a respective temperature value is determined, which is indicative of the temperature of the respective lighting device 6. In step 103 it is determined whether the respective connection feature value indicates a relatively good coupling or a relatively bad coupling. Preferentially, the determined respective connection feature value is compared with a threshold, in order to determine whether the respective coupling quality can be regarded as being relatively good or relatively bad. For instance, if the respective connection feature value is indicative of a temperature of the respective lighting device 6, it can be determined whether the respective connection feature value indicates a temperature being larger than a temperature threshold, wherein, if this is the case, the determined respective connection feature value may be regarded as indicating a relatively bad coupling quality. If it is determined that the respective connection feature value indicates a relatively good coupling between the connectors of the respective power providing device 4 and the respective lighting device 6, in step 104 the respective power providing unit 8 is operated in the second operational mode, in order to provide the higher power to the respective lighting device 6. If it is determined that the respective coupling quality is relatively bad, in step 105 the respective power providing unit 8 remains in its first operational mode and the respective lighting device 6 outputs a signal indicating the relatively bad quality. For instance, in step 105 an LED 11 of a respective lighting device 6 may be controlled such that it provides a blinking signal or a signal having a certain color like a red color, in order to indicate to an installer that the quality of the respective coupling is not sufficient.

Although in above described embodiments each lighting device 6 comprises a single LED 11 only, in other embodiments the lighting devices can of course comprise more than one LED. The lighting devices, which can also be regarded as being LED modules, if they comprise one or several LEDs, can be adapted for outdoor or indoor applications, especially for spotlight applications.

Especially for LED modules a well-defined thermal interface is important. Particularly if several LEDs are placed in a high density configuration in an LED module, a good cooling of the LED module is important, in order to guaranty a specified performance like a specified intensity, a specified colored temperature, et cetera. If an LED module has not been well connected to a second USB-PD connector via which power is provided to the LED module, the LED module can get overheated and the performance level may drop. For example, if a socketable LED module like a Twistable Fortimo DLM module from the company Philips has not been screwed properly into the second USB-PD connector, which might be the connector of a luminaire into which the LED module should be screwed, in particular if it has not reached its end position, the generated heat in the LED module may not be transferred away via the second USB-PD connector to, for instance, the luminaire and overheating of the LED module may occur.

The lighting system described above with reference to FIGS. 2 to 6 provides therefore a direct feedback for informing the installer or another user about the quality of the thermal interface after installation/mounting of the lighting device. By providing an optical feedback via the respective lighting device itself, the user can be informed about the status of the mounting.

The lighting system described above with reference to FIGS. 1 to 6 provides a direct optical feedback on the quality of the installation/mounting, thereby informing or warning the user that the lighting device has not been installed correctly. For instance, if the lighting device has not been screwed in sufficiently tied or a socketable lighting device has not been twisted completely, the lighting device can provide an optical signal like a blinking signal or a red light signal in case of a lighting device having, for instance, colored LEDs. This testing of the installation and outputting of an optical signal, if the installation has a bad quality, is preferentially done in the first operational mode, which may also be regarded as being a safe low power mode, before switching to the second operational mode. The lighting device is therefore preferentially also able to output light, if the lower power is provided, and not only, if the higher power is provided. In the first operational mode the power providing unit may provide 5 V and 5 A and in the second operational mode the power providing unit may provide 20 V and 5 A. However, the power providing unit can also be adapted to provide other power values.

The lighting system can be adapted to measure the operating temperature of the lighting device by monitoring the LED junction temperature, in order to detect potential problems with respect to the thermal interface. The actual junction temperature may be derived by measuring the relative forward voltage of an LED, i.e. the forward voltage compared to, for instance, an initial starting forward voltage. The operating temperature of the lighting device can also directly be measured by reading out an embedded temperature sensor, which may be embedded in the lighting device. The determined operating temperature can be regarded as being a connection feature value being indicative of the quality of the connection formed by a first USB-PD connector of the lighting device and a second USB-PD connector via which the lighting device receives power. For transferring the temperature information from the lighting device to, for instance, a power providing device a power modulated signal over the Vbus line of the USB-PD connection can be used, wherein this function can be added as a customized function or command in the USB-PD protocol. Also other communication means can be used for reading out the temperature information. For instance, a wireless connection may be provided to transfer the temperature information or, in another embodiment, another connection feature value to, for instance, the power providing device or to another unit which uses the information for determining whether the coupling quality is sufficient and for outputting a signal, if this is not the case.

By determining and providing the connection feature value, in particular, by measuring and reading out the temperature of the lighting device, which may also be regarded as being a module temperature, in the first operational mode before switching to the second operational mode, potential damage to the lighting device may be avoided. The signal, which is preferentially an information light signal and which should be output, if the connection feature value indicates an insufficient coupling quality, is preferentially generated in the first operational mode.

The lighting system can be adapted such that, if the connection feature determination unit has determined the connection feature value being indicative of a feature of the connection formed by a first USB-PD connector of a certain lighting device and a second USB-PD connector and if the determined connection feature value indicates an insufficient coupling, the respective optical signal is output by neighboring lighting devices and optionally also by the lighting device for which the connection feature value has actually been determined. Thus, neighboring lighting devices may inform the user about the mounting status of a lighting device. In this case the determined connection feature value may be transferred to the neighboring lighting devices by using known communication techniques, for instance, a power modulated signal over the Vbus line of the USB-PD connection or a wireless communication technique like Bluetooth, WiFi or Zigbee.

Although in above described embodiments in the first operational mode the connection feature value is determined, wherein, if the connection feature value indicates an insufficient coupling, this is indicated to a user by outputting a signal, while the lower power is still provided in the first operational mode, wherein the power provision is not switched into the second operational mode in which the higher power is provided, in another embodiment the power provision may be switched to a third operational mode in which the higher power is provided, even if the determined connection feature value indicates an insufficient coupling, wherein in this case the kind of operating the power providing unit in the second operational mode and the third operational mode may be different. For instance, the power providing unit may be adapted to be operated by using PWM, wherein the duty cycle of the PWM may have a larger value in the second operational mode than in the third operational mode and wherein the power providing unit may be operated in the second operational mode, if the connection feature value indicates a sufficient coupling, and in the third operational mode, if the connection feature value indicates an insufficient coupling. Whether the connection feature value indicates a sufficient or an insufficient coupling may be determined by thresholding the connection feature value. Thus, if the connection feature value indicates an insufficient coupling, the power providing unit may provide the higher power with a lower duty cycle, wherein the lighting device may provide an optical signal indicating the insufficient coupling quality in the third operational mode used with the lower duty cycle.

Especially in the case of having a lighting system in accordance with the USB-PD standard there might be a risk that wiring has been twisted, for instance, in self-made do-it-yourself USB-PD connectors and cable assemblies. The lighting system described above with reference to FIGS. 1 to 6 can therefore also be adapted to detect miswiring and to indicate the miswiring via the lighting device. In particular, the connection feature determination unit can be adapted to determine whether there is miswiring and to provide the connection feature value such that it is indicative of whether miswiring has been determined. In particular, the connection feature value determination unit can be adapted to measure a current flowing from the power providing unit to the second USB-PD connector and to determine whether there is miswiring depending on this current measurement. Instead of or in addition to determining miswiring, the lighting device, especially the connector of the lighting device, can comprise a rectifier, in particular a low-loss rectifier, in order to avoid problems with miswiring.

Although in above described embodiments the connection feature determination unit is integrated in the lighting device, in other embodiments it can also be integrated in other devices like the power providing device or it can be a separate device. Moreover, the connection feature determination unit can be a distributed unit which is distributed over several devices, wherein different subunits of the contact feature determination unit may determine different kinds of contact feature values. For instance, a subunit integrated in the lighting device may determine a temperature value being indicative of the temperature of the lighting device as a first contact feature value and a further subunit integrated in the power providing device may determine a contact feature value being indicative of miswiring. If several contact feature values are determined, the control unit may control the operational mode of the power providing unit by using power rules defining the operational mode of the power providing unit depending on the determined contact feature values. For instance, the power rules can define that the power providing unit provides the higher second power only, if all determined connection feature values indicate a sufficient connection quality which may be determined by thresholding.

Although in the above described embodiments the output unit is integrated with the lighting device such that the lighting device is also the output unit and the LED of the lighting device is not only used for illumination purposes, but also for outputting a signal indicating, for instance, an insufficient coupling quality, in other embodiments the output unit can be an additional unit which is not integrated in a lighting device. The output unit, either integrated with a lighting device or being a separate output unit, can provide different failure signals depending on the kind of failure. For instance, if the determined connection feature value indicates an insufficient heat coupling, a first optical signal can be provided, and, if it indicates miswiring, another second optical signal can be provided by the output unit.

The first and second USB-PD connectors are preferentially adapted to provide a high power transfer of, for instance, 100 W, to be oriented to each other in several ways, to provide a relatively high data transfer rate and to handle relatively large thermal loads. The lighting system may be used in retail spot applications. In this case the lighting device may be regarded as being a retail spot which is attached to a power track via the power providing device. The power providing device can be regarded as being a spot driving unit for driving the retail spot. Known spot driving units are often relatively large, obtrusive and technically relatively complex, in order to allow the retail spot to be tilted and rotated. In contrast, the combination of first and second USB-PD connectors described above, especially with reference to FIGS. 4 to 6, allow for a technically relatively simple rotation of a retail spot or another lighting device to a desired position. Moreover, because of the USB-PD connection, the first and second USB-PD connectors allow for a control of the retail spot by using the USB-PD standard. The first and second USB-PD connectors can provide a robust mechanical rotatable connection with a mechanical lock function by actuating, for instance, the ring element or the lever, wherein the connection allows for a relatively high power transfer and allows for a good thermal coupling.

Figure 8:
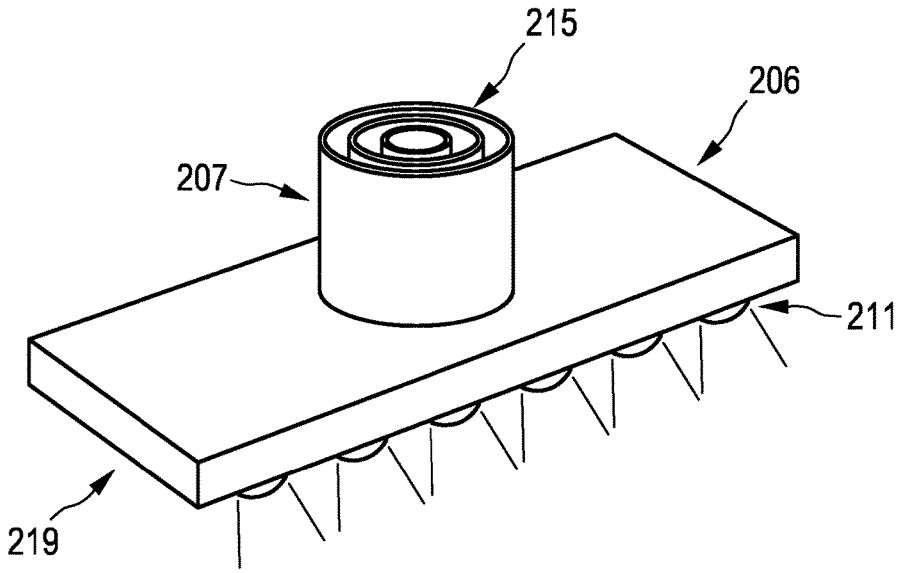
FIGS. 8 to 11 illustrate schematically and exemplarily further embodiments of a first USB-PD connector of a lighting device and of a second USB-PD connector of a power providing device.
Figure 9:
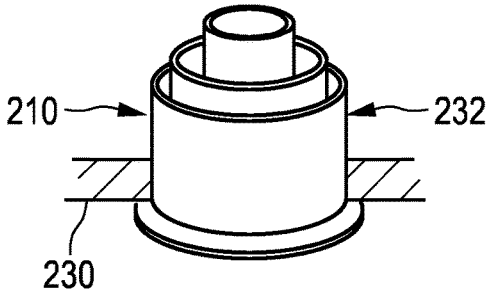
Figure 10:
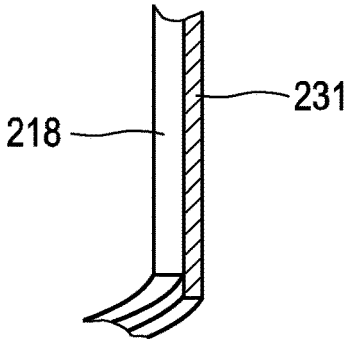

Although the first and second USB-PD connectors described above with reference to, for instance, FIGS. 4 to 6 have a certain construction, in other embodiments the first and second USB-PD connectors can be constructed in another way. For instance, as schematically and exemplarily shown in FIGS. 8 to 10, a lighting device 206 with several LEDs 211 and a housing 219 may comprise a first USB-PD connector 207 having cylindrical bushing shaped electrical coupling elements 215 to be connected with a second USB-PD connector 210 integrated in, for instance, a ceiling 230 of a room, wherein the second USB-PD connector 210 comprises a staggered arrangement 232 of bushing shaped electrical coupling elements 218 and insulator elements 231. One of these electrical coupling elements 218 and one these insulator elements 231 is schematically and exemplarily illustrated in FIG. 10. The bushing shaped electrical coupling elements 218 and insulator elements 231 are cylindrical, i.e. each element forms a hollow cylinder or a part of a hollow cylinder like a hollow half cylinder.

The insulator elements 231 are arranged in between the electrical coupling elements 218, in order to electrically insulate neighboring electrical coupling elements 218 from each other. Preferentially, the insulator elements 231 are arranged on the respective outer surfaces of the respective bushing shaped electrical coupling elements 218, wherein there is a gap between an insulator element 231 arranged on an outer surface of a bushing shaped electrical coupling element 218, which faces a neighboring bushing shaped electrical coupling element 218, and the neighboring bushing shaped electrical coupling element 218. A bushing shaped electrical coupling element 215 of the first USB-PD connector 207 can be inserted into this gap. As schematically and exemplarily illustrated in FIG. 10, the insulator elements 231 may protrude relative to the electrical coupling elements 218 at the introduction side where the first USB-PD connector 207 is introduced into the second USB-PD 210, in order to reduce the likelihood of a short cut.

The bushing shaped electrical coupling elements 215, 218 provide a relatively large contact interface, when the first and second USB-PD connectors 207, 210 have been introduced into each other. Thus, the bushing shaped electrical coupling elements 215, 218 can provide good heat dissipation. However, in other embodiments the first USB-PD connector and/or the second USB-PD connector can also be constructed in another way. For instance, one of the first and second USB-PD connectors can still comprise bushing shaped electrical coupling elements and the other of the first and second USB-PD connectors can comprise electrical spring contacts embedded in bushing shaped insulator elements.

Figure 11:
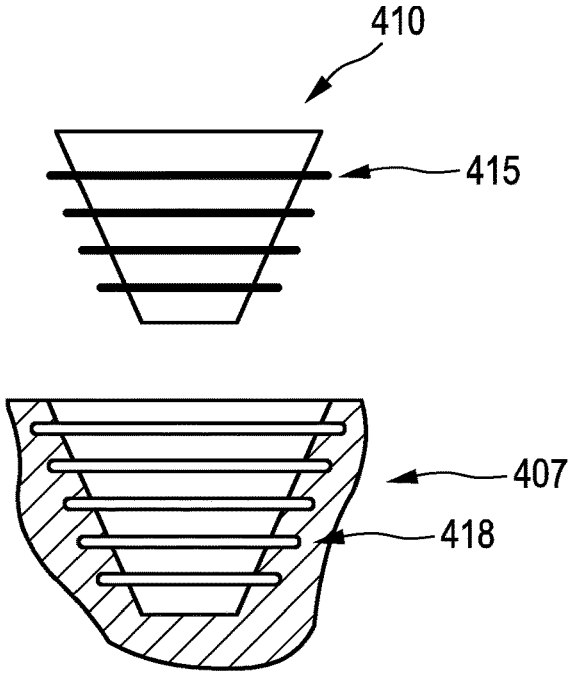

FIG. 11 shows schematically and exemplarily a further embodiment of a female first USB-PD connector 407 and a male second USB-PD connector 410. In this embodiment the first and second USB-PD connectors 407, 410 are conically shaped, in order to reduce the likelihood that the male USB-PD connector 410 is not fully inserted into the female USB-PD connector 407. The male USB-PD connector 410 comprises extendable electrical coupling elements 415, which may be outside of the male USB-PD connector 410 as schematically and exemplarily indicated in FIG. 11 or inside the male USB-PD connector 410. Preferentially, the extendable electrical coupling elements 415 are inside the male USB-PD connector 410 while being inserted into the female USB-PD connector 407, wherein, after the male USB-PD connector 410 has been fully inserted into the female USB-PD connector 407, the electrical coupling elements 415 are extended, in order to provide an electrical contact with corresponding elements 418 of the female USB-PD connector 407. Also in this embodiment the couplings elements 418 of the female connector 407 may be formed by ring-like grooves in which the electrical coupling elements 415 can be inserted, in order to establish an electrical, mechanical and thermal coupling between the two connectors 407, 410. The male USB-PD connector 410 can comprise a state change element like the above described ring element or lever, which may be actuated by a user like an installer for changing the state of the electric coupling elements 415 from being inside the male USB-PD connector 410 to being outside the male USB-PD connector 410 or vice versa.

In an embodiment a grid of rotational USB-PD slots, i.e. of the second USB-PD connectors described above with reference to, for instance, FIGS. 4 and 9 to 12, can be integrated in a ceiling for flexible positioning of, for example, accent lighting in retail applications. In an embodiment the lighting devices may not need a driver, because they may be controlled via the USB-PD data protocol. Since USB-PD can deliver up to 100 W, power can be provided which can cover a large range of retail light intensities. The round shape of the first and second USB-PD connectors allows the respective lighting device to be rotated. A further mechanical element like a hinge can be added, in order to allow the lighting device also to be tilted. The second USB-PD connector may be used as a standardized socket connector for consumer lamps, professional lamps, LED spots, LED modules, et cetera, for, for instance, street lighting, retail lighting, or other lighting applications.

Figure 12:
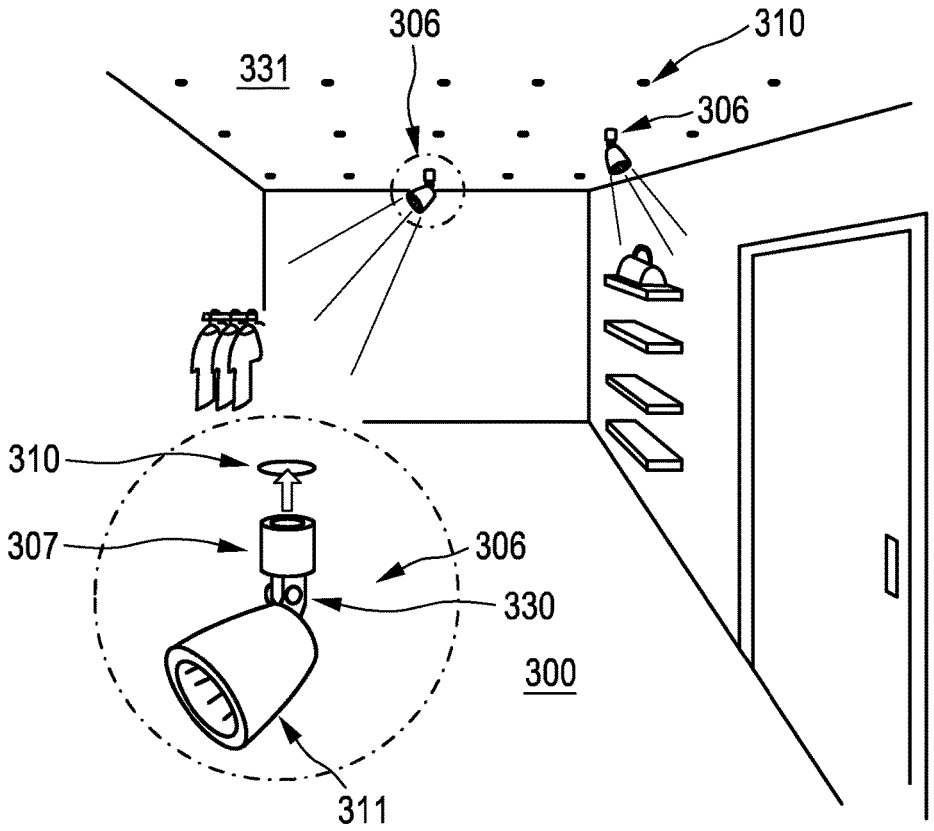
FIG. 12 shows schematically and exemplarily a room with several lighting devices.

FIG. 12 schematically and exemplarily shows several second USB-PD connectors 310 being round socket connectors embedded in a ceiling 331 of a room 300, wherein lighting devices 306 having first USB-PD connectors 307 can be connected with desired socket connectors 310. The lighting devices 306 further comprise a mechanical element 330 for tilting a light source 311 like an LED of the lighting device 306. For rotating the lighting device 306 within the socket 310 an additional mechanical construction is not required, because the first USB-PD connector 307 can be rotated within the second USB-PD connector 310.

The first and second USB-PD connectors described above with reference to FIGS. 4 to 6 and 11 provide a rotatable USB-PD connection, with a latch function that combines mechanical fixation, electrical connection and thermal conduction. The male and female parts are joined by 'plugging', for instance, an LED module into a socket. Once the user has rotated the LED module to the correct position, the metal contacts, i.e. the coupling element, can be extended from the socket (or the LED module) as described above with reference to FIGS. 5, 6 and 11. These contacts, which are comparable to the pins in a USB-PD connector, provide for an electrical connection between the male and female parts. Preferentially, both power and data will traverse over this connection. The mechanical fixation can be provided by these contacts or by other means. Preferably the same user action, e.g. a twisting or pinching motion, provides for both the electrical connection and mechanical fixation.

As the LED module will need to dissipate heat, the rotatable USB-PD plug can act as a heat sink, where heat is transferred from the LED module to the socket. The power providing device, especially the socket of the power providing device, can be equipped with heat dissipation means. This may allow for a "fool proof" installation of the LED module.

Although in above described embodiments the lighting devices comprise LEDs, in other embodiments the lighting devices can comprise other light sources.

Moreover, in an embodiment also further electrical components can be coupled to the power providing device. In particular, the power providing device can comprise further second USB-PD connectors for being connected to first USB-PD connectors of other electrical components like sensors, interface modules especially network interface modules, et cetera. The connection feature determination unit can be adapted to determine a connection feature value being indicative of a feature of the connection between the power providing device and the further electrical component and the controlling system can be adapted to control the power provision to the further electrical component based on the determined connection feature value and optionally control the output unit to output a signal depending on the connection feature value, especially similar to the control of the power providing unit and optionally the output unit described above with reference to the connection between the power providing device and the lighting device. In case of a connection between the power providing device, which may be regarded as being a luminaire to which the lighting device has been connected, and a network interface module the connection feature determination unit may be adapted to determine a connection feature value being indicative of the status of the network interface, wherein the power provision to the network interface module, i.e. the operational mode of the power providing unit, may be controlled depending on the status of the network interface.

Although in above described embodiments the first and second USB-PD connectors can be rotated relative to each other, after they have been inserted into each other, in order to allow the lighting device to be rotated to a desired rotational position, in other embodiments the first and second USB-PD connectors may be mechanically constructed such that they can be inserted into each other in only one or only few certain relative rotational positions. For instance, they can be non-circularly shaped such that they can be inserted into each other in a single relative rotational position or in one of a few predefined relative rotational positions. In particular, the first and second USB-PD connectors may have a rectangular shape, a triangular shape, et cetera in a transversal cross section. In an embodiment one of the first and second USB-PD connectors may have an element, which is dimensioned and shaped such that it corresponds to a corresponding element of the other of the first and second USB-PD connector, wherein these elements are positioned, shaped and dimensioned such that the first and second USB-PD connectors can be inserted into each other in only a single relative rotational position or in one of few possible relative rotational positions and wherein in the single relative rotational position or the few possible relative rotational positions the corresponding elements of the first and second USB-PD connectors engage with each other. Each of the first and second USB connectors can have one or several of these elements. Thus, in an embodiment an engaging construction can be used to ensure that the first and second USB-PD connectors are inserted into each other in a certain relative rotational position. If in an embodiment the power providing device is a luminaire comprising optical elements like lenses and/or reflectors and if the lighting device should be oriented in a predefined way relative to the optical elements, this may be ensured by orienting the first USB-PD connector of the lighting device and the second USB-PD connector of the luminaire relative to each other correspondingly, wherein the correct orientation of the USB-PD connectors relative to each other may be ensured by mechanically constructing the USB-PD connectors such that only this correct relative rotational position of the USB-PD connectors is possible, if they are inserted into each other.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

Procedures like the provision of the power, the determination of the connection feature value, the thresholding, the control of the components of the lighting system, et cetera performed by one or several units or devices can be performed by any other number of units or devices. These procedures, especially the control of the lighting system in accordance with the control method can be implemented as program code means of a computer program and/or as dedicated hardware.

A computer program may be stored/distributed on a suitable medium, such as an optical storage medium or a solid-state medium, supplied together with or as part of other hardware, but may also be distributed in other forms, such as via the Internet or other wired or wireless telecommunication systems.

Any reference signs in the claims should not be construed as limiting the scope.

The invention relates to a lighting system comprising a lighting device having a first USB-PD connector and a power providing unit, which is preferentially a component of a power providing device and which is operable in different operational modes. A second USB-PD connector is electrically connected with the power providing unit and adapted to be connected with the first USB-PD connector for generating a USB-PD connection via which power and optionally also data are receivable by the lighting device. A connection feature value being indicative of a feature of the connection is determined and the operational mode of the power providing unit is controlled depending on the determined connection feature value. This allows for a reaction on the current connection situation. For instance, if the connection feature value indicates a relatively low thermal coupling, the power providing unit may provide less power.

The invention claimed is:

1. A lighting system comprising:

a power providing unit for providing power to a lighting device, wherein the power providing unit is operable in different operational modes, the lighting device, wherein the lighting device has a first USB-PD connector, a second USB-PD connector electrically connected with the power providing unit and being adapted to be connected with the first USB-PD connector for generating a connection via which the provided power is receivable by the lighting device, a connection feature determination unit for determining a connection feature value being indicative of a feature of the connection formed by the first USB-PD connector and the second USB-PD connector, wherein the connection feature value indicates the quality of a thermal coupling of the connection, and a controlling system for controlling the lighting system, wherein the controlling system is adapted to control, in which operational mode the power providing unit is operated, depending on the determined connection feature value.

2. The lighting system as defined in claim 1, wherein the power providing unit is adapted to provide in a first operational mode a first power and in a second operational mode a second power, wherein the first power is lower than the second power.

3. The lighting system as defined in claim 2, wherein the controlling system is adapted to control the lighting system such that a) the connection feature determination unit determines the connection feature value while the power providing unit is in the first operational mode and b) the power providing unit changes from the first operational mode to the second operational mode depending on the determined connection feature value.

4. The lighting system as defined in claim 2, wherein the power providing unit is adapted to provide the power by using pulse-width modulation having a duty cycle, wherein the power providing unit is adapted to be operable in a third operational mode, in which the power providing unit provides the second power with a duty cycle being smaller than the duty cycle used in the second operational mode, wherein the controlling system is adapted to control the lighting system such that a) the connection feature determination unit determines the connection feature value while the power providing unit is in the first operational mode and b) the power providing unit changes from the first operational mode to the third operational mode depending on the determined connection feature value.

5. The lighting system as defined in claim 1, wherein the connection feature determination unit is adapted to determine a temperature value being indicative of the temperature of the lighting device and/or of the first USB-PD connector and/or of the second USB-PD connector and/or of the power providing unit as the connection feature value.

6. The lighting system as defined in claim 1, wherein the lighting system further comprises an output unit for outputting a signal depending on the connection feature value.

7. The lighting system as defined in claim 6, wherein the output unit and the lighting device are integrated such that the signal is output as an optical signal via the lighting device.

8. The lighting system as defined in claim 6, wherein the power providing unit is adapted to provide in a first operational mode a first power and in a second operational mode a second power, wherein the first power is lower than the second power, wherein the controlling system is adapted to control the output unit such that the signal is output depending on the connection feature value while the power providing unit is operated in the first operational mode.

9. The lighting system as defined in claim 1, wherein the connection feature determination unit is adapted to determine whether the connection comprises miswiring and to provide the connection feature value such that it is indicative of whether miswiring has been determined.

10. The lighting system as defined in claim 1, wherein the first and second USB-PD connectors are adapted such that they are connectable to each other by plugging the first and second USB-PD connectors into each other, by rotating the first and second USB-PD connectors relatively to each other to a relative rotational position and by mechanically fixing the first and second USB-PD connectors relative to each other at the relative rotational position.

11. The lighting system as defined in claim 10, wherein the first USB-PD connectors and/or the second USB-PD connector comprises extendable electrical coupling elements, in order to provide the mechanical fixing by extending the electrical coupling elements.

12. A power providing device for being used within the lighting system as defined in claim 1, wherein the power providing device comprises:

a power providing unit for providing power to a lighting device of the lighting system, wherein the power providing unit is operable in different operational modes, a second USB-PD connector electrically connected with the power providing unit and being adapted to be connected with a first USB-PD connector of the lighting device for generating a connection via which the provided power is receivable by the lighting device, wherein the connection feature value indicates the quality of a thermal coupling of the connection formed by the first USB-PD connector and the second USB-PD connector, a controller for controlling, in which operational mode the power providing unit is operated, depending on a connection feature value determined by a connection feature determination unit of the lighting system.

13. A control method for controlling a lighting system as defined in claim 1, the controlling method comprising:

determining a connection feature value being indicative of a feature of a connection, which is formed by a first USB-PD connector of a lighting device and a second USB-PD connector electrically connected with a power providing unit and via which provided power is receivable by the lighting device, wherein the connection feature value indicates the quality of a thermal coupling of the connection, and controlling, in which operational mode the power providing unit is operated, depending on the determined connection feature value.

14. A computer program for controlling a lighting system as defined in claim 1, the computer program comprising program code means for causing the controlling system of the lighting system to carry out the steps of a control method when the computer program is run on the controlling system.

* * * * *